United States Patent [19]

Murata

[11] 4,008,907

[45] Feb. 22, 1977

[54] HEEL PIECES OF SKI BINDINGS

[75] Inventor: Masahiro Murata, Tokyo, Japan

[73] Assignee: Hope Kabushiki Kaisha, Tokyo, Japan

[22] Filed: Aug. 28, 1975

[21] Appl. No.: 608,638

[30] Foreign Application Priority Data

Aug. 31, 1974 Japan ..... 49-105196[U]

[52] U.S. Cl. ..... 280/614; 280/620

[51] Int. Cl.² ..... A63C 9/08

[58] Field of Search ..... 280/11.35 E, 11.35 C, 280/11.35 K, 11.35 Y, 11.35 A, 11.35 D, 11.35 T, 614, 618, 620, 615

[56] References Cited

UNITED STATES PATENTS

| | | | |
|---|---|---|---|
| 2,686,059 | 8/1954 | Whitaker | 280/11.35 Y |
| 2,868,555 | 1/1959 | Barnett et al. | 280/11.35 K |
| 3,244,431 | 4/1966 | Hatalpa | 280/11.35 E |
| 3,326,565 | 6/1967 | Cubberly | 280/11.35 K |
| 3,797,843 | 3/1974 | Salomon | 280/11.35 K |
| 3,877,712 | 4/1975 | Weckeiser | 280/11.35 E |

FOREIGN PATENTS OR APPLICATIONS

| | | | |
|---|---|---|---|
| 1,181,104 | 11/1964 | Austria | 280/11.35 K |
| 1,926,108 | 11/1970 | Germany | 280/11.35 E |
| 255,999 | 2/1949 | Switzerland | 280/11.35 E |

*Primary Examiner*—Philip Goodman
*Assistant Examiner*—David M. Mitchell
*Attorney, Agent, or Firm*—Diller, Brown, Ramik & Wight

[57] ABSTRACT

In a heel piece of a ski binding of the type wherein the fore end of the heel piece is pivotally connected to a base plate which is secured to the ski, a locking member is provided for releasably locking the heel piece to the base plate. When the heel piece is locked it is impossible for the skier to vertically rotate the heel piece so that the state of the ski becomes suitable for climbing up a slope, whereas when the heel piece is unlocked, it is possible to vertically rotate the heel piece so that the state of the ski becomes suitable for walking or running on a horizontal surface.

6 Claims, 9 Drawing Figures

HEEL PIECES OF SKI BINDINGS

BACKGROUND OF THE INVENTION

This invention relates to an improvement of a ski binding and, more particularly, to a heel piece of a ski binding which can readily convert the state of the ski from a state suitable for walking or running to a state suitable for climbing.

Most of the ski bindings for student use are one touch step-in type and Kandahar type leather bindings. However, bindings of both types are accompanied by problems. More particularly, when teaching skiing to students, coachings of how to walk (run) (so-called Nordic) and how to slide down a slope (so-called Alpen) are important. With the one touch step-in type binding the heel of the ski boot can not move in the vertical direction with respect to the ski and, accordingly, it is extremely difficult to coach Nordic. On the other hand, with the Kandahar type binding, although it is free to move the heel in the vertical direction, the bindings are liable to swing in the transverse direction of the ski so that this type of binding is not sufficiently safe for Alpen skiing. Especially young students are liable to break bones or sprain the ankles when they fall forwardly.

SUMMARY OF THE INVENTION

It is an object of this invention to provide a novel heel piece of a ski binding capable of readily converting the state of the heel piece from a state suitable for walking or running on a horizontal surface to a state suitable for climbing up or sliding down a slope and vice versa.

Another object of this invention is to provide an improved heel piece which in addition to the feature just described has a feature of permitting a limited longitudinal movement to the heel piece thereby rendering the ski to be more suitable for climbing up or sliding down a slope.

According to this invention, there is provided a heel piece of a ski binding comprising a base plate secured to the ski, a connecting member having one end pivotally mounted on a pin carried by the base plate and extending in the transverse direction of the ski, means for pivotally connecting the other end of the connecting member to an intermediate point of the heel piece, and a locking member mounted on the heel piece for releasably locking the same to the base plate thereby preventing vertical movement of the heel piece.

According to a modification of this invention, an auxiliary base plate is slidably mounted on a main base plate, one end of the connecting member is pivotally mounted on the auxiliary base plate and the fore end of the heel piece is connected to the auxiliary base plate through a pin and slot connection so that when the heel piece is released it can not only rotate in the vertical direction but is permitted to make a limited longitudinal movement so that the skier can easily climb up or slide down a slope.

Description of the Preferred Embodiments

Figure 1:
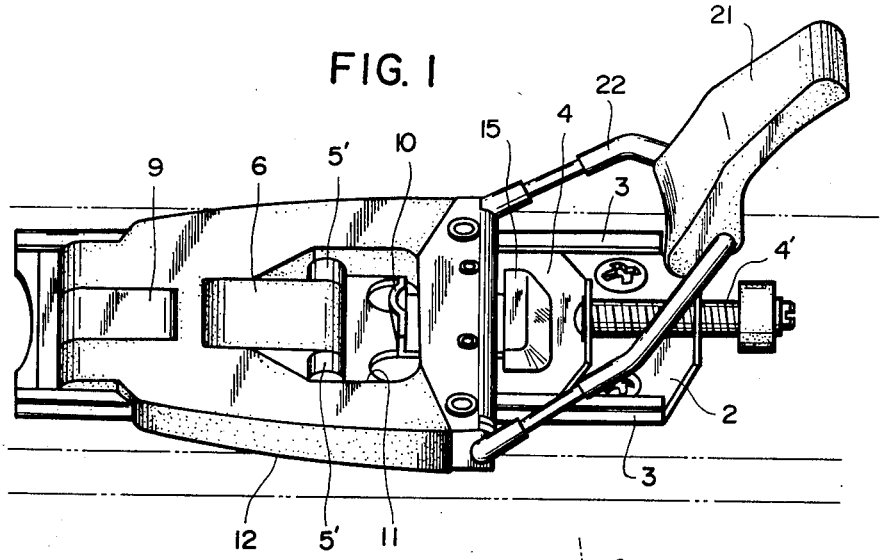
FIG. 1 is a perspective view of a heel piece of a ski binding embodying the invention.
Figure 2:
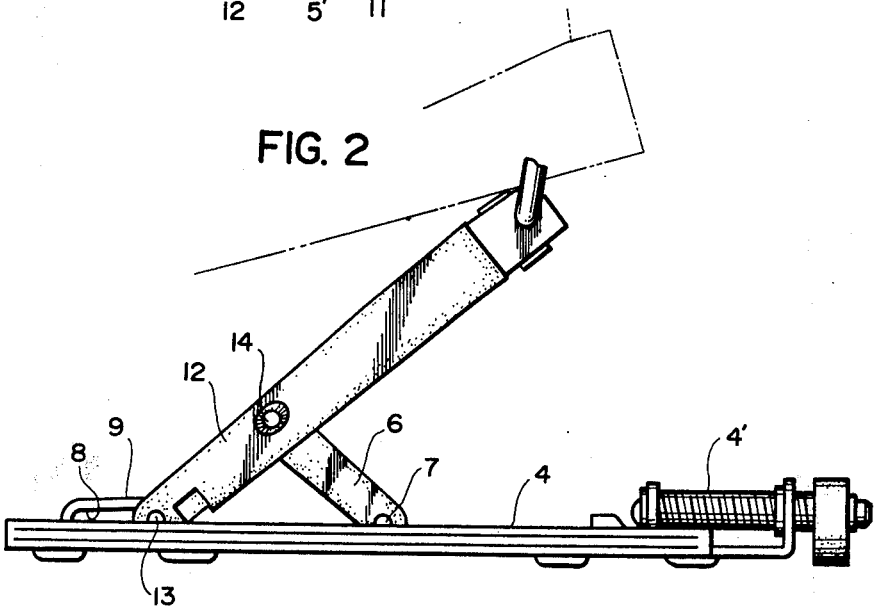
FIG. 2 is a side view of the heel piece shown in FIG. 1.
Figure 3:
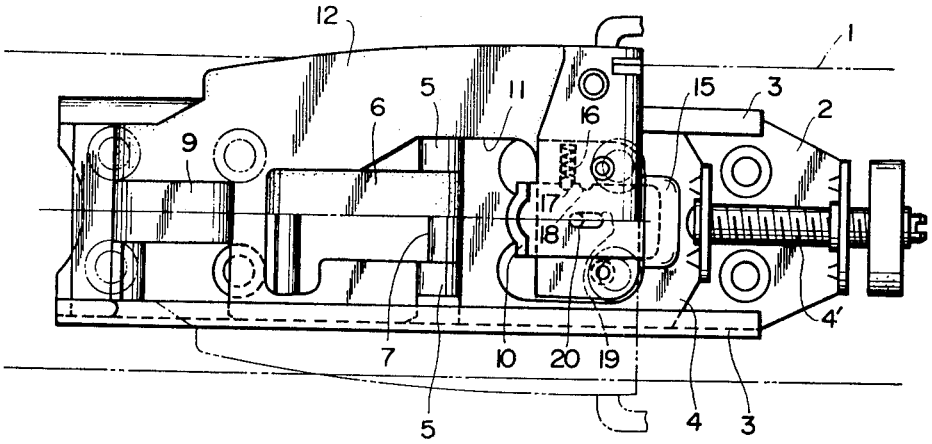
FIG. 3 is a plan view of the heel piece.
Figure 4:
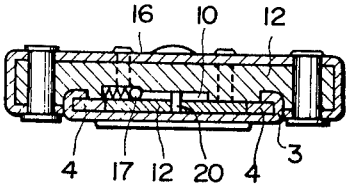
FIG. 4 is a transverse sectional view of the heel piece.
Figure 5:
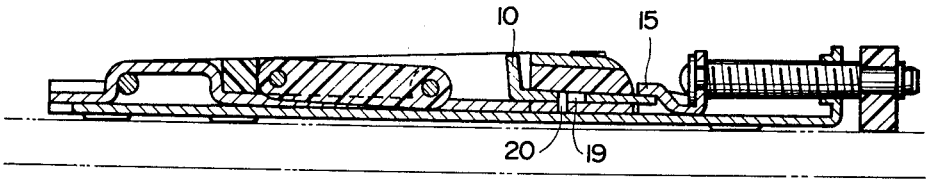
FIG. 5 is a longitudinal sectional view of the heel piece.

Referring now to FIGS. 1 to 5 of the accompanying drawings, a base plate 2 of the heel piece embodying the invention which is secured to a ski 1 is provided with guide member 3 on both sides thereof. An auxiliary base plate 4 is slidably supported between the guide members 3 and one end of a position adjusting bolt 4' threaded through a bent up flange 2' of the base plate 2 is rotatably secured to one end of the auxiliary base plate 4. A pair of bearing pedestals 5' are secured at about the center of the longitudinal direction of the auxiliary base plate 4 for supporting the opposite ends of a transverse pin 5 extending through a connecting member 6 having substantially the same width as the spacing between the bearing pedestals 5'. A stamped out member 9 provided with a longitudinal slot 8 is formed at the fore end of the auxiliary base plate 4. A pin 13 secured to the fore end of the main body 12 of the heel piece is slidably received in the slot 8, the main body 12 being provided with an opening 11 of a sufficient size to receive the connecting member 6 and a locking member 10 to be described later. The pin 13 and the longitudinal slot 8 cooperatively define a lost-motion connection between the main body 12 and the auxiliary base plate 4 allowing the main body 12 to slide longitudinally and pivot about a transverse axis relative to the auxiliary base plate 4. The lefthand end of the connecting member 6 is pivotally connected to the mainbody 12 at an intermediate point by means of a pin 14.

Bent up portion 15 is formed near the rear end of the auxiliary base plate 4 for engaging the end of the locking member 10 which is provided at the rear end of the main body 12. In the present embodiment, the locking member 10 is received in a space defined between a recess formed in the lower rear portion of the main body 12 and a base plate 12' and is slidable in the longitudinal direction of the ski. A spring loaded ball 16 is provided for the rear end of the main body 12 in the lateral direction of the ski for cooperating with notches 17 and 18 formed along one side edge of the locking member 10 for forming two click stops. A pin 20 is secured to the main body 12 and extends through a longitudinal slot 19 provided for the locking member 10 for preventing disengagement of the locking member. The opposite legs of a U shaped frame 22 carrying a buckle 21 in the form of an eccentric cam are rotatably connected to the rear end of the main body 12.

When the locking member 10 is inserted in the bent up portion 15, the main body 12 of the head piece is secured to the auxiliary base plate 4 so that the main body 12 can not move. As a result, the ski boot (not shown) secured to the main body 12 by the buckle 21 can move neither in the vertical direction nor to the left or right thus providing a heel piece suitable for descent and rotation.

When the locking member 10 is pulled out of the bent up portion 15, the main body 12 is freed from the auxiliary base plate 14 thus permitting the pin 13 to slide in the slot 7. As a consequence the skier can raise and lower the rear end of the main body 12 by rotating the connecting lever 6 about the pin 7. In other words, he can move the heel of the ski boot in the vertical direction. Thus the ski is brought into a condition suitable for climbing up and walking.

In a modification shown in FIGS. 6 to 9, a letter C shaped base plate 31 is secured to a ski (not shown) by means of screws passing through openings 35. Opposite legs of the base plate 31 are bent in the form of circles to form transverse bearing openings 32 for receiving a pin 36. One end of a connecting member 37 having a width substantially equal to the spacing between the legs of the base plate 31 is pivotally mounted on pin 36.

Figure 7:
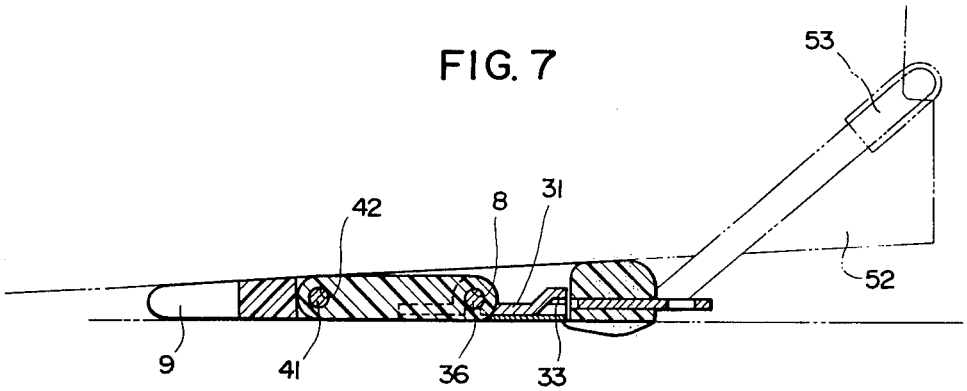
FIG. 7 is a longitudinal sectional view of the heel piece shown in FIG. 6.

The main body of the heel piece 39 is provided with a transverse bearing hole 40 near the fore end thereof to receive a pin 41 which also extends through a transverse opening 42 at the fore end of the connecting member 37. At the center of the main body of the heel piece 39 is formed a recess 43 for accommodating the base plate 31 and the connecting member 37 so that it is possible to fold base plate 31 and the connecting member 37 to be flush with the heel piece 39 as shown in FIG. 7.

Lateral projections 44 are formed on both sides of the main body of the heel piece 39 near the rear end thereof. Longitudinal grooves 45 are provided for the lower surfaces of projections 44 for receiving a spring wire 53 of the binding. An opening is formed at the center of the rear end of the main body of the heel piece 39 to receive a locking member 46 slidable in the longitudinal direction of the ski. One side of the locking member 46 is provided with a plurality of notches 47 for a click stop including a ball 48 and a biasing spring 49. A bottom plate 50 is secured to the bottom of the main body 39 by means of screws 51 for defining a space for containing the locking member 46 and the click stop mechanism.

Figure 6:
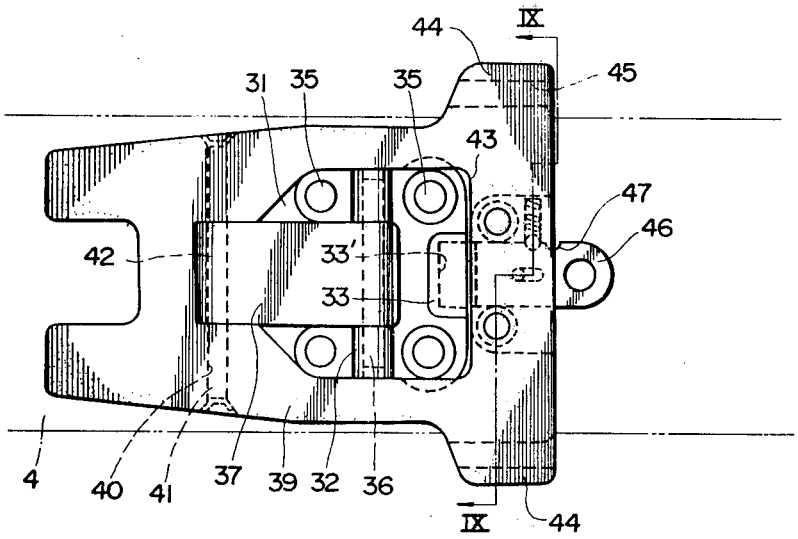
FIG. 6 is a plan view showing a modified heel piece of simplified construction.
Figure 8:
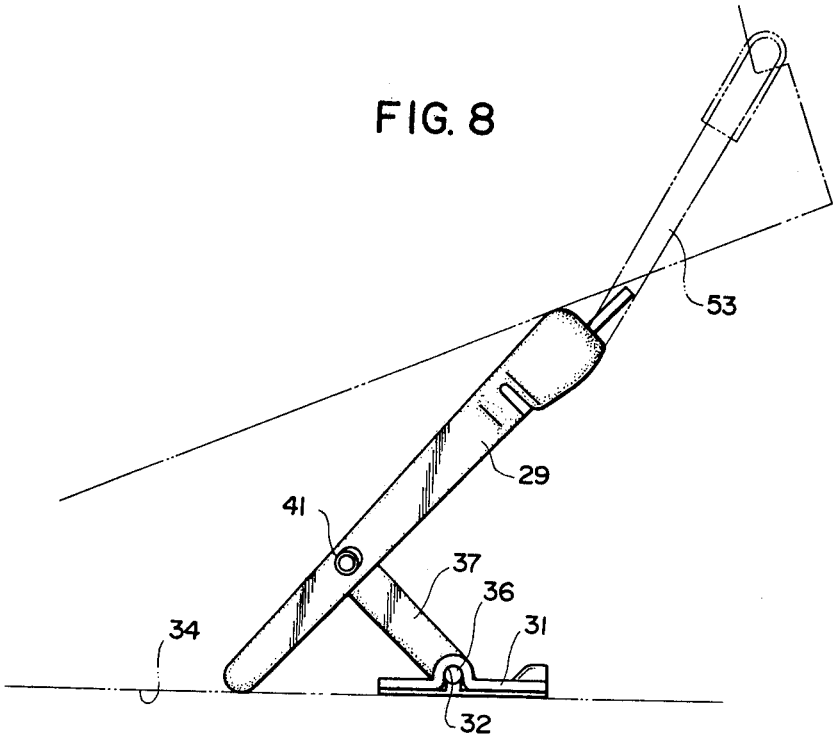
FIG. 8 is a diagram for explaining the operation of the modified heel piece.
Figure 9:
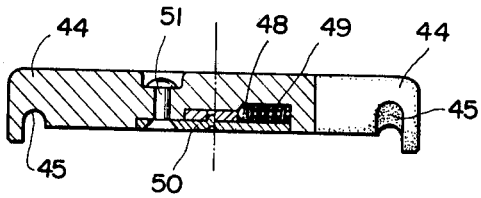
FIG. 9 is a sectional view taken along a line IX - IX shown in FIG. 6.

The heel piece of the ski binding of this invention described above is used together with a toe piece (not shown) but preferably provided with a safety mechanism that releases the toe of the ski boot when a dangerous load is applied. The heel 52 of a ski boot is clamped to the heel piece by engaging the rear end of a spring wire 53 against the shoulder of the heel 52 as shown in FIG. 7 and by passing the fore end of the spring wire 53 through the grooves 44. When the locking member 46 is disengaged from opening 33 of a bent up portion 33 formed on the base plate 31 as shown in FIG. 6, the main body of the heel piece 39 is released from the base plate 31 whereby the main body 39 can rotate freely about the pin 41 as shown in FIG. 8. Accordingly, the skier can readily walk or run on a horizontal surface. Where the length of the connecting member 37 and the position of the connecting pin 41 are selected suitably, it is possible to minimize the movement of the spring wire in longitudinal direction of the ski although the heel piece moves or rotates within a definite limit, thereby minimizing the force applied to the toe piece. Further, different from the prior art Kandahar type binding, according to this invention the heel 52 of the ski boot is permitted to move only in the vertical direction, the transverse movement thereof being limited to a very small value, i.e. only the clearance of the bearing members.

To climb up or slide down a slope the locking member 46 is inserted into the opening 33' thus locking the main body of the heel piece 39 to the base plate 31 and hence to the ski. As a result, the skier can easily manipulate the ski.

As above described, the invention provides an improved ski binding including an improved heel piece suitable for walking, running and climbing or sliding.

What is claimed is:

1. A heel piece of a ski binding comprising a base plate adapted to be secured to a ski, a longitudinally extending connecting member having a first end pivotally mounted on a pin carried by said base plate and extending in a transverse direction of an associated ski, a heel piece, means for pivotally connecting a second end of said connecting member at a point longitudinally intermediate said heel piece, a locking member mounted on said heel piece for releasably locking the same to said base plate thereby preventing vertical rotary movement of said heel piece, and means for forming a lost-motion connection between said heel piece and said base remote from said locking member.

2. The heel piece according to claim 1 wherein said locking member is mounted on the rear end of said heel piece to be slidable in the longitudinal direction of an associated ski and said base plate is provided with a vertically oriented opening at its rear end for receiving said locking member.

3. The heel piece according to claim 1 wherein said heel piece is provided with a recess, said base plate is of a size to be received in said recess and is provided with two legs laterally spaced a distance substantially equal to the width of said connecting member so that when said heel piece is locked to said base plate, said heel piece, base plate and said connecting member become substantially flush.

4. A heel piece of a ski binding comprising a main base plate adapted to be secured to a ski, an auxiliary base plate having fore and aft ends, said auxiliary base plate is slidable on said main base plate in the longitudinal direction of an associated ski, means for adjustably connecting said auxiliary base to said main base plate, a longitudinally extending connecting member having one end pivotally mounted on a pin mounted on said auxiliary base plate and extending in the transverse direction of an associated ski, a heel piece provided with a slot having fore and aft ends, means for connecting the fore end of said heel piece to the fore end of said auxiliary base plate to be slidable in the longitudinal direction of the ski and pivotal transversely of an associated ski, means to pivotally connect the other end of said connecting member to the fore end of the slot of said heel piece, a locking member provided at the rear end of said heel piece to cooperate with said auxiliary base plate, and a clamping buckle provided at the rear end of said heel piece for clamping securement to a ski boot.

5. The heel piece according to claim 4 wherein said locking member is connected to said heel piece through a pin and another longitudinal slot, and said heel piece is provided with spring biased ball cooperating with notches formed on a side of the locking member.

6. The heel piece according to claim 4 wherein said auxiliary base plate is provided with a bent up portion near the rear end thereof for receiving said locking member.

* * * * *